US006468191B1

(12) United States Patent
Cameron

(10) Patent No.: US 6,468,191 B1
(45) Date of Patent: Oct. 22, 2002

(54) ABDOMEN EXERCISE BENCH

(76) Inventor: Larry Cameron, 1796 Ponder Dr., Talbott, TN (US) 37877

( * ) Notice: Subject to any disclaimer, the term of this patent is extended or adjusted under 35 U.S.C. 154(b) by 0 days.

(21) Appl. No.: 09/902,877

(22) Filed: Jul. 11, 2001

(51) Int. Cl.[7] ..... A63B 26/00; A63B 71/00
(52) U.S. Cl. ..... 482/140; 482/142; 602/32
(58) Field of Search ..... 482/140, 142, 482/148, 907; 602/32; 606/242, 243

(56) References Cited

U.S. PATENT DOCUMENTS 4,244,358 A * 1/1981 Pyers ..... 128/74
5,094,449 A 3/1992 Stearns
5,836,859 A 11/1998 Van Herle
6,030,322 A 2/2000 Webber
6,090,022 A 7/2000 Colecchi

* cited by examiner

*Primary Examiner*—Michael A. Brown
*Assistant Examiner*—Lori Baker Amerson
(74) *Attorney, Agent, or Firm*—Pitts & Brittian, P.C.

(57) ABSTRACT

An abdomen exercise bench includes a frame, which includes a base for resting upon a floor. A generally planar upper body platform is secured to the frame in a position generally parallel to the floor. A generally planar, elongated abdomen platform, having a first end and a second opposed end, is rotatably mounted upon the frame, adjacent to the upper body platform, for rotation about an axis generally parallel to the upper body platform. A restraint is provided for preventing a user from sliding off the abdomen platform during rotation.

8 Claims, 4 Drawing Sheets

ABDOMEN EXERCISE BENCH

CROSS-REFERENCE TO RELATED APPLICATIONS

Not applicable

TECHNICAL FIELD

The present invention relates generally to exercise equipment and more particularly to an apparatus for rotational exercise of the human abdomen.

BACKGROUND OF THE INVENTION

There are various types of equipment available for exercising different portions of the human anatomy, including the abdomen. For example, U.S. Pat. No. 5,094,449 issued to Stearns discloses an exercise apparatus for abdominal exercises. This large, complex apparatus includes a main fixed frame having a seat for the user and three separate movable frames pivotally mounted to each other adjacent to the fixed frame for simulating torso movements. A series of weights are provided for variable resistance to the movements. While perhaps effective in providing exercise for a human abdomen, this exercise apparatus requires substantial space and is complex in manufacture and operation.

Many people who exercise want equipment that does not require large amounts of space, is easy to move to a different location and is not expensive because of the complexities of manufacture.

Accordingly, it is an object of the present invention to provide an abdomen exercise bench that is not complex to manufacture.

It is also an object of the present invention to provide an abdomen exercise bench that is simple for user to operate.

It is a further object to provide an abdomen exercise bench that is easily movable from one location to another location.

Other objects and advantages of the present invention will be recognized when the following description is considered along with the drawings.

SUMMARY OF THE INVENTION

In one embodiment of the present invention, a rigid frame includes a base adapted to rest upon a floor. The frame also includes an elongated first post extending upwardly from the base and an elongated second post extending upwardly from the base. A support frame member extends between the first post and the second post. A generally planar upper body platform is secured to the support frame member adjacent to the first post. A generally planar lower body platform is secured to the support frame member adjacent to the second post. An elongated generally planar abdomen platform is rotatably mounted upon the support frame member for rotation by the user about an axis generally parallel to the floor. The rotation of the abdomen platform by the user causes the user to exercise the muscles around the entire abdomen.

BRIEF DESCRIPTION OF THE DRAWINGS

The above mentioned features of the invention will become more clearly understood from the following detailed description of the invention read together with the claims and drawings in which:

BEST MODE FOR CARRYING OUT THE INVENTION

Figure 1A:
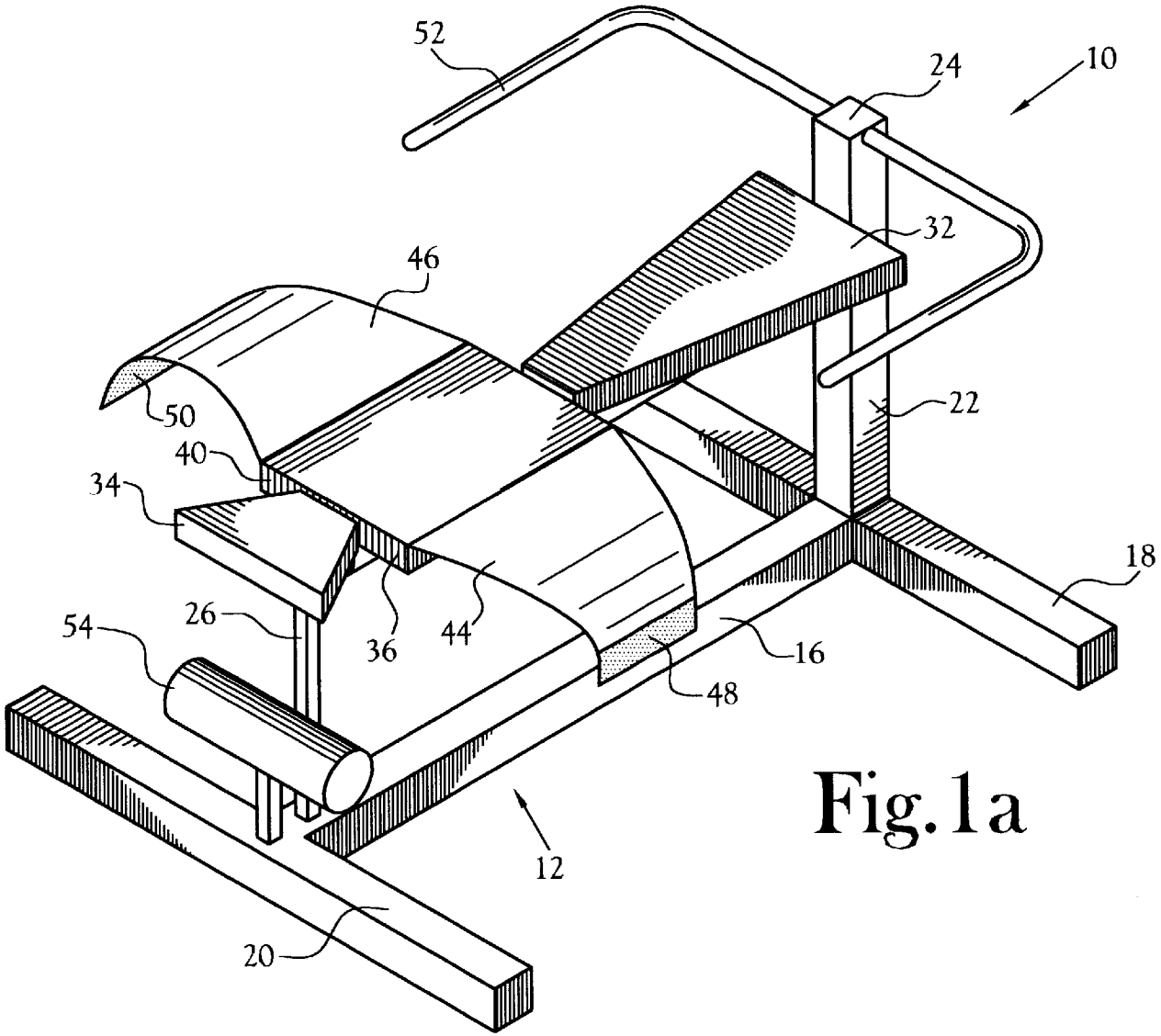
FIG. 1*a* is a perspective view of an abdomen exercise bench in accordance with the present invention in a rest position.
Figure 1B:
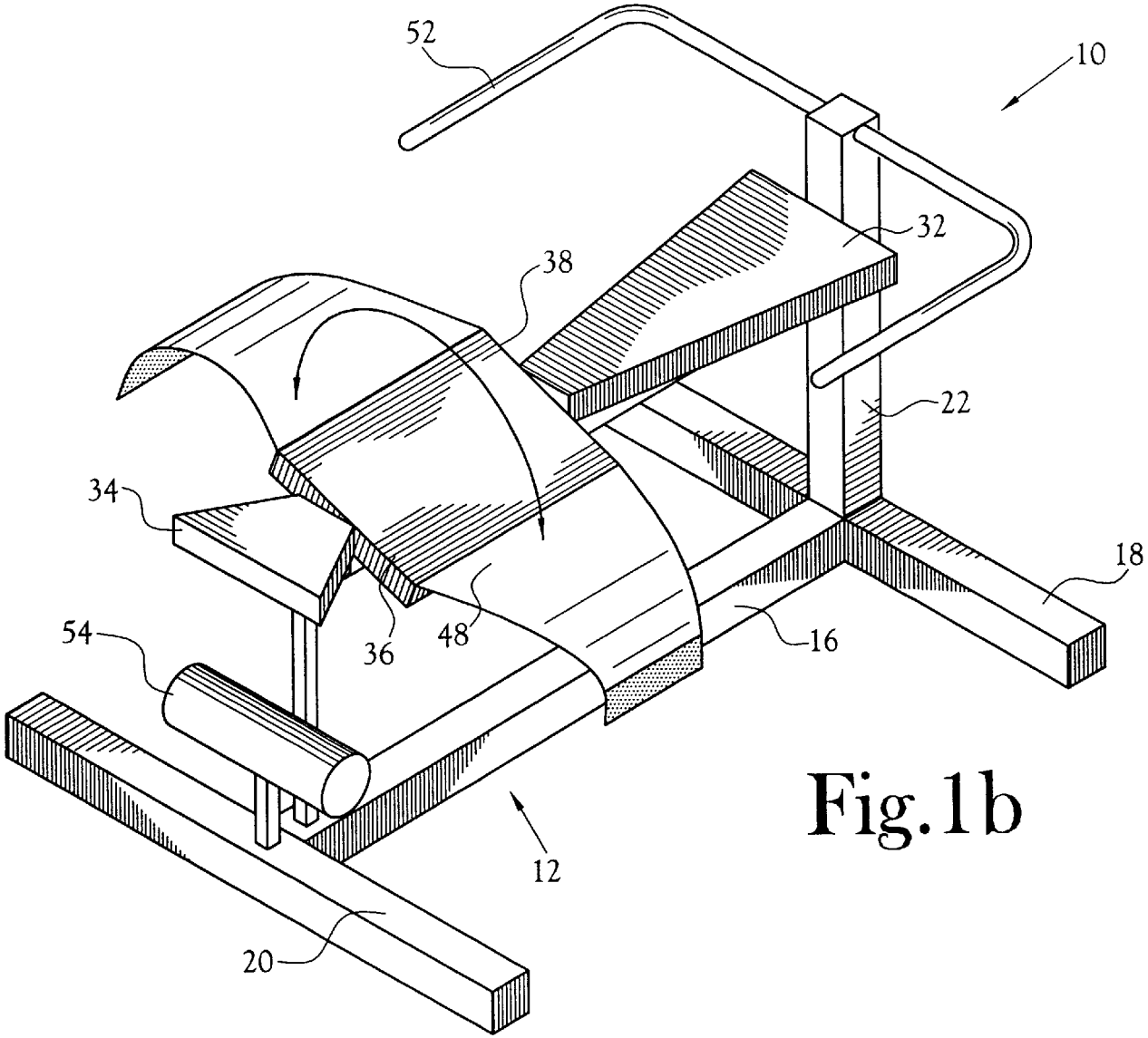
FIG. 1*b* is a perspective view of an abdomen exercise bench in accordance with the present invention in a rotated position.

Referring now to the Figures in which like reference numerals indicate like or corresponding features, there is depicted in FIG. 1*a* an abdomen exercise bench 10 that includes a base 12. The base 12 is generally H-shaped including a longitudinal member 16 and opposing cross members 18 and 20. The base 12 is planar to rest in a stable manner on a floor. A first post 22 is secured to and extends upwardly from the cross member 18 to a top end 24. A second post 26 is secured to and extends upwardly from the cross member 20 to a top end 28. A support member 30 is secured to and extends between the first post 22 and the second post 26. The support member 30 is oriented generally parallel to the base 12 resting on the floor.

Figure 2:
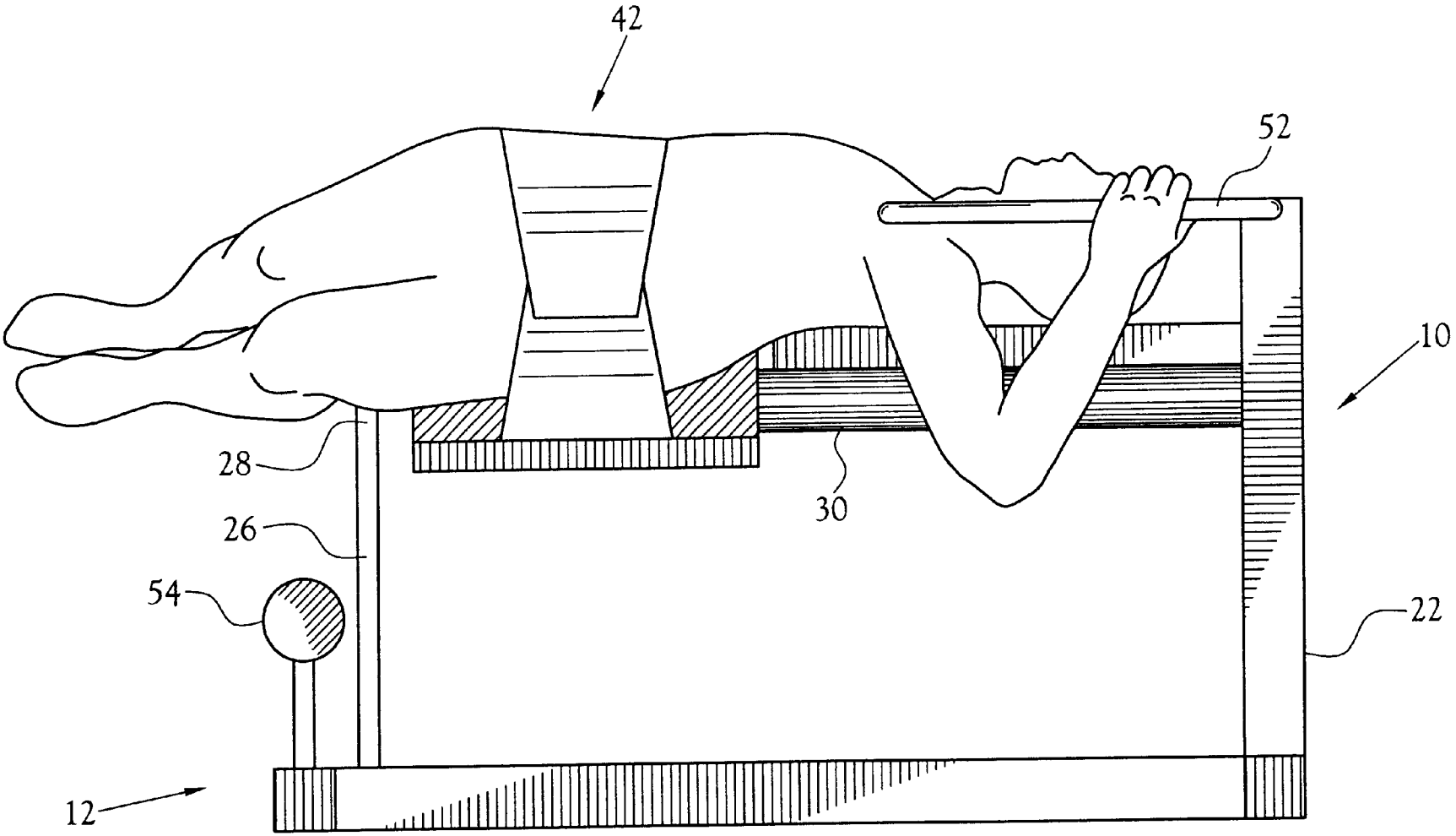
FIG. 2 is an elevation view of an abdomen exercise bench in accordance with the present invention in a rotated position.
Figure 3:
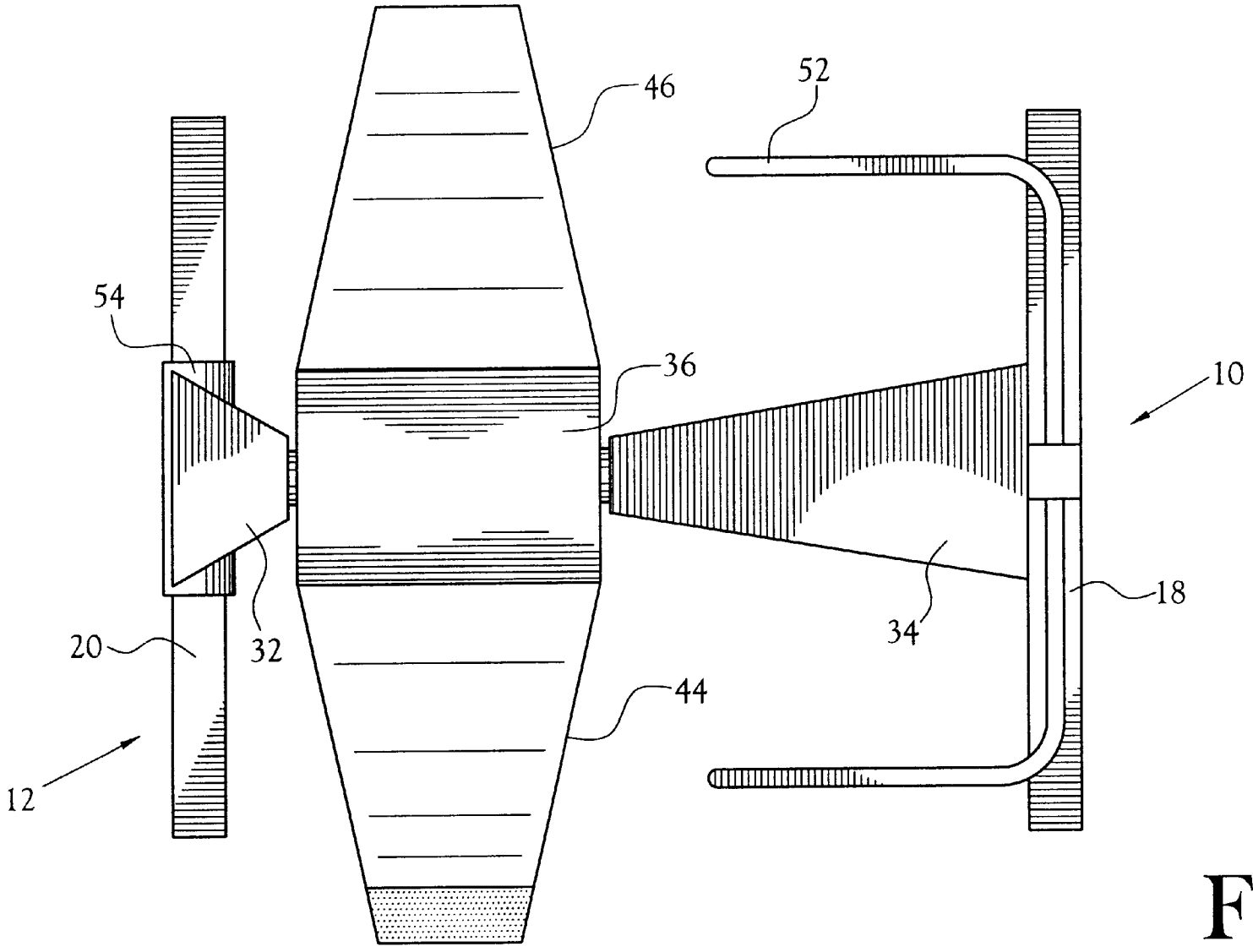
FIG. 3 is a plan view of an abdomen exercise bench in accordance with the present invention in a rest position.

A generally planar upper body platform 32 is secured on the support member 30 adjacent to the first post 22. The upper body platform is sized to support the head, neck and chest of the user as (s)he reclines upon the bench 10, as depicted particularly in FIG. 2.

A generally planar lower body platform 34 is secured to the support member 30, adjacent to the second post 26. The lower body platform 34 is generally coplanar with, and spaced apart from, the upper body platform 32.

An elongated, generally planar abdomen platform 36, having a first end 38 and a second end 40 is mounted on the support member 30 between the upper body platform 32 and the lower body platform 34. The abdomen platform 36 is rotatable approximately 45 degrees in either direction about the support member 30. In the center position of its rotation, the abdomen platform 36 is generally coplanar with the upper body platform 32 and the lower body platform 34. As desired, the rotation of the abdomen platform 36 may be restricted by a spring (not shown) mounted upon the support member 30. In order to secure the abdomen platform in a fixed position while the user mounts the bench, a lock pin (not shown) may be provided to extend through apertures defined in the support member 30.

A restraint 42 is provided to prevent a user from sliding from the bench 10 as the abdomen platform 36 is rotated. In the depicted embodiment, the restraint 42 comprises a pair of fabric belts 44 and 46, each of which is secured along an edge of the abdomen platform 36. The belt 44 includes the hook portion 48 of a hook-and-loop fastening system. The belt 46 includes the loop portion 50 of a hook-and-loop fastening system.

A handle bar 52 is secured to the first post 22 adjacent to the top end 24. The handle bar 52 is generally C-shaped and circularly tubular to allow easy grasping with both hands by the user as (s)he is reclined on the bench 10.

A foot restraint 54 is mounted upon the cross member 20 to allow the bench 10 to be used as a sit-up bench when the abdomen platform 36 is secured in a fixed position. The foot restraint, the upper body platform32, the lower body platform 34 and the abdomen platform 36 are preferably padded with a soft material, such as vinyl-covered foam rubber, for example, to provide comfort for the user.

In use, the bench rests upon a floor and the abdomen platform is restrained in a position generally coplanar with the upper body platform 32 and the lower body platform 34. The user sits upon the lower body platform 34 facing away from the first post 22, with his/her feet resting upon the floor. The user then reclines upon the abdomen platform 36 and the upper body platform 32, resting his/her head upon the upper body platform 32. The belts 44 and 46 are then draped over the user's abdomen and secured to one another, as with the hooks 48 and loops 50. The user is then secured to the abdomen platform 36.

Safely secured to the abdomen platform, with the user's feet still on the floor for stability, if a lock pin has been provided, it may be removed to allow rotation of the abdomen platform 36. The user then grasps the handle bar 52 with both hands and lifts his/her feet from the floor, raising his/her knees toward his/her chest. Then, using the handle bar 52 for resistance, the user rotates the lower portion of his/her body back and forth with the abdomen platform 36. If a spring is provided in the attachment of the abdomen platform to the support member, there can be an increasing level of resistance to rotation as the abdomen platform is rotated.

After completion of the exercise session, the abdomen platform 36 is returned to its starting position, coplanar with the upper body platform 32 and the lower body platform 34, and the user returns his/her feet to rest on the floor and may release the handle bar 52. If a lock pin is provided, it is inserted to stabilize the abdomen platform 36. The hooks 48 and loops 50 are disengaged and the belts 44 and 46 are separated and allowed to flex away from the abdomen platform 36. The user sits up and is ready to leave the bench 10.

Using an exercise bench in accordance with the present invention, essentially all of the muscles of the abdominal area are exercised to increase muscle tone and eliminate fat. The bench is economical to construct and is easily move from one location to another as desired by the user.

While a preferred embodiment has been shown and described, it will be understood that it is not intended to limit the disclosure, but rather is intended to cover all modifications and alternate methods and apparatus within the spirit and scope of the invention as defined in the appended claims.

I claim:

1. An abdomen exercise bench comprising:

a frame including a base for resting upon a floor;

a generally planar upper body platform secured to said frame in a position generally parallel to said floor;

a generally planar, elongated abdomen platform, having a first end adjacent to said upper body platform and a second opposed end, rotatably mounted upon said frame, for rotation about a longitudinal axis generally parallel to said upper body platform; and a restraint for preventing a user from sliding off said abdomen platform during rotation.

2. An abdomen exercise bench as set forth in claim 1 and further comprising:

a handlebar secured to said frame.

3. An abdomen exercise bench as set forth in claim 1 and further comprising:

a generally planar lower body platform secured to said frame in a position generally parallel to said floor.

4. An abdomen exercise bench as set forth in claim 1 and further comprising:

a foot restraint secured to said frame.

5. An abdomen exercise bench as set forth in claim 1 and further comprising:

a releasable lock securing said abdomen platform in a position generally parallel to said upper body platform.

6. An abdomen exercise bench as set forth in claim 1, wherein said restraint comprises a first belt secured to said abdomen platform and having a distal end section, a second belt secured to said abdomen platform and having a distal end section and a releasable fastener securing said distal end section of said first belt to said distal end section of said second belt.

7. An abdomen exercise bench as set forth in claim 6, wherein said fastener comprises hook and loop materials.

8. An abdomen exercise bench as set forth in claim 1 and further comprising:

a rotation resistor restricting rotation of said abdomen platform.

* * * * *